United States Patent [19]

McIntyre et al.

[11] 4,082,059

[45] Apr. 4, 1978

[54] COATING APPARATUS WITH INTERMITTENT SUBSTRATE BACKUP

[75] Inventors: Donald B. McIntyre; Frederic S. McIntyre, both of Wellesley Hills, Mass.

[73] Assignee: Acumeter Laboratories, Inc., Newton Lower, Mass.

[21] Appl. No.: 743,324

[22] Filed: Nov. 19, 1976

Related U.S. Application Data

[62] Division of Ser. No. 537,064, Dec. 30, 1974, Pat. No. 4,020,194.

[51] Int. Cl.[2] ..... B05C 3/12

[52] U.S. Cl. ..... 118/407; 118/253

[58] Field of Search ..... 118/410, 411, 247, 238, 118/407, 211, 253, 401; 68/200, 203, 204; 101/172; 427/256, 261, 288

[56] References Cited

U.S. PATENT DOCUMENTS

| | | | |
|---|---|---|---|
| 1,594,583 | 8/1926 | Wood | 118/410 |
| 2,368,520 | 1/1945 | Burckhardt et al. | 118/401 |
| 2,371,871 | 3/1945 | Burckhardt | 118/253 X |
| 2,474,691 | 6/1949 | Roehm | 118/410 |
| 2,565,451 | 8/1951 | Hoitt | 118/253 |
| 2,704,530 | 3/1955 | Nilsen et al. | 118/253 X |
| 3,083,640 | 4/1963 | Milner | 101/172 |
| 3,113,884 | 12/1963 | Kohler | 427/288 |
| 3,201,275 | 8/1965 | Herrick | 118/401 X |
| 3,218,654 | 11/1965 | Tano et al. | 68/203 X |
| 4,046,099 | 9/1977 | Komatsu | 68/203 X |

FOREIGN PATENT DOCUMENTS

| | | | |
|---|---|---|---|
| 2,346,825 | 3/1975 | Germany | 118/253 |

*Primary Examiner*—Morris Kaplan

*Attorney, Agent, or Firm*—Rines and Rines, Shapiro and Shapiro

[57] ABSTRACT

The present disclosure relates to novel fluid application processes and apparatus wherein fluid extruded through a nozzle is wiped off the nozzle at varopis angles of attack by forcing a moving sheet, web, or other article against the nozzle in a controlled manner as the same moves past the nozzle, thus to produce predetermined in-line coatings upon the sheet, web, or other article, ranging from an array of dots and lines to an array of bands or elongated continuous bands of coating fluid.

8 Claims, 5 Drawing Figures

Figure 2:
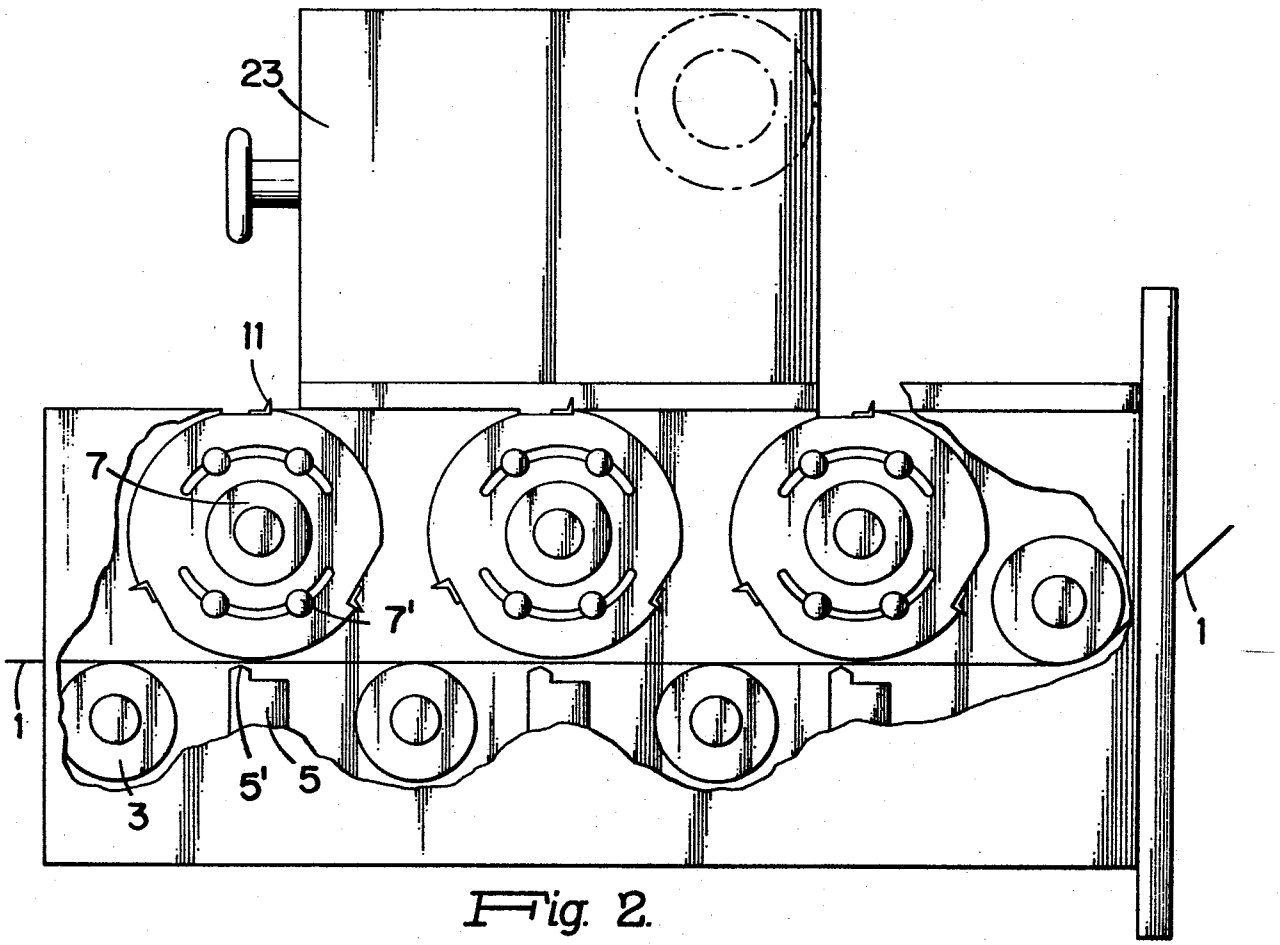

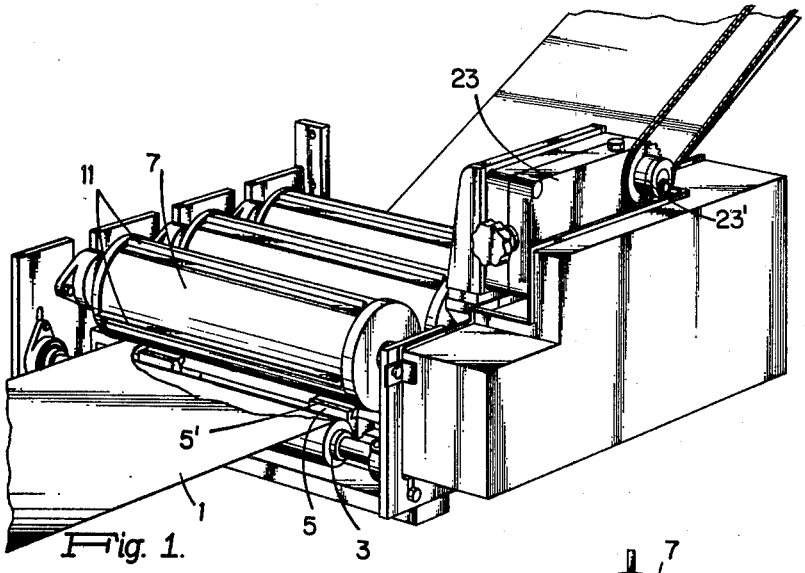
Fig. 1.
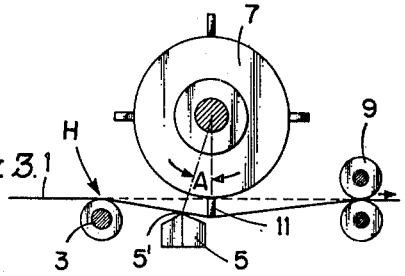
Fig. 3.
Fig. 4.
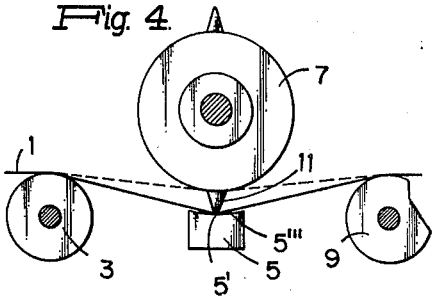
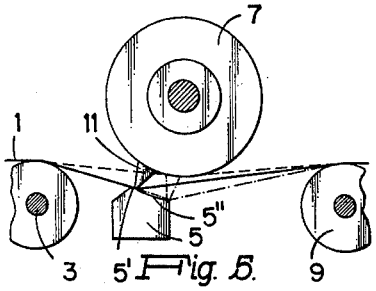
Fig. 5.

COATING APPARATUS WITH INTERMITTENT SUBSTRATE BACKUP

This is a division of application of Ser. No. 537,064 filed Dec. 30, 1974 now U.S. Pat. No. 4,020,194.

The present invention relates to apparatus for the application of fluids, being more particularly concerned with fluid distribution mechanisms for coating materials on surfaces being hereinafter generically referred to as "sheets" or "sheet means" or the like, for such purposes as, for example, hot melt adhesive, solvent type pressure-sensitive adhesive, resins, plastic, or other fluid materials.

Fluid distribution mechanisms for depositing fluid coatings in predetermined patterns (including intermittent configurations) upon surfaces such as sheets and the like, have been employed through the years in a wide variety of applications. In the illustrative example of adhesive coatings and the like, dispensers involving shuttered openings and nozzles have been employed as described, for example, in U.S. Letters Pat. No. 3,174,689, issued Mar. 23, 1965 to the applicant D. B. McIntyre herein. Such fluid distribution systems have sometimes employed hot melt dispenser apparatus, for example, where the adhesive material and the like is converted from solid to molten form and continuously distributed along predetermined patterns, with or without a bumper spot, for such uses as the adhesive coating of papers and other materials. Apparatus of this nature may, for example, be of the form described in U.S. Letters Pat. No. 3,323,510, issued June 6, 1967 to said D. B. McIntyre.

The philosophy underlying such and related techniques has principally resided in the forcing of the adhesive or other fluid out of nozzle structures and upon moving sheets and the like at controlled instants of time and for controlled intermittent periods of time with the aid of metered units such as, for example, the Type 1BUP2 marketed by Acumeter Laboratories, Inc., Newton Lower Falls, Massachusetts, or other well-known types of fluid metering mechanism. A further example of such an intermittent expanded-nozzle construction and system for the intermittent application of such coatings and deposits upon moving sheets or articles is described in U. S. Letters Pat. No. 3,595,204, issued July 27, 1971 to said D. B. McIntyre and F. S. McIntyre. Clearly, however, other types of fluid application and distribution apparatus may be and have been employed for related purposes.

There are occasions, however, where either the fineness of the dots, lines, or other patterns of this fluid coating to be deposited, or the rate of high speed of the sheet or other material, imposes too stringent conditions upon metered distribution nozzles and the like. For example, with a web or sheet moving at an approximately 1000 feet per minute rate or 16 feet per second, the estimated time for an application of adhesive one-eighth inches long in the direction of web travel, would require an on-time of three-fourths of one millisecond. The fastest practical electrical devices, such as solenoid valves, however, are capable of cycling at rates of the order of a cycle in about 30 milliseconds, more or less, making the use of such techniques for applying adhesive and the like thus unfeasible for the purposes of the present invention.

An object of the invention, accordingly, is to provide a new and improved apparatus for fluid application that is particularly, though not exclusively, adapted for adhesive coatings and the like, and which is well suited for the high-speed and fine-dimensioned coating applications before discussed that cannot be practically mechanically shuttered from fluid application systems.

A further object is to provide a novel fluid applicator apparatus and system of more general use, as well. A further illustration of possible usage of the invention, indeed, resides in applying a solution across a moving web to penetrate the fibers of the substrate and facilitate the softening of these fibers so that subsequent folding of the web at the softened location will ultimately overcome the cracking of the fibers. Other applications will also immediately suggest themselves to those skilled in this art.

In summary, however, from one of its broader aspects, the invention contemplates an apparatus of fluid application that comprises moving a sheet under tension at a predetermined speed longitudinally past a predetermined transverse line; periodically rotationally forcing a projection against one side of the sheet in the vicinity of said transverse line to deflect the sheet thereat; producing on the opposite side of the sheet along said transverse line globules of fluid to be coated; timing such globule production to occur at the time of and between the periodic deflection of the sheet; and adjusting the size of the globules to be sufficient to contact the sheet on the said opposite side along said transverse line when the sheet is deflected in order to cause the deflected sheet to wipe off the globules as coatings thereupon. Preferred adjustment and constructional details, together with other objects of the invention, are more particularly delineated in the appended claims.

The invention will now be described with reference to the accompanying drawings, FIG. 1 of which is an isometric view of an adhesive coating application of the invention, in preferred form;

FIG. 2 is a side elevation upon an enlarged scale, with parts broken away to show the fluid application mechanism of FIG. 1; and FIGS. 3 to 5 are fragmentary longitudinal sections illustrating various adhesives or other fluid application details suitable for the system of FIGS. 1 and 2.

It is believed most conducive to operational explanation of the apparatus underlying the invention, to consider first the principles of fluid application illustrated in FIGS. 3-5 before discussing their embodiment in the practical system of FIGS. 1 and 2.

Referring to FIG. 3, a paper sheet or other web 1 is shown entering from the left, over an adjustable idler roll 3, and passing longitudinally over a transverse extrusion nozzle 5, as of the types previously described and as described in said Letters Patent, and under a bumper roll mechanism 7, rotating counter-clockwise, and thence proceeding under tension through draw rolls 9, to the right. The bumper roll 7 is driven synchronously with the web, as later explained, and mounts one or more transverse projections or blades 11 on its surface, being driven at the same effective speed as the web 1 or faster than web speed and causing the projections 11 periodically to deflect the web 1 towards the nozzle 5, the orifice 5' of which is disposed preferably off-center at an angle A to the vertical axis of the bumper roll 7, shown to the left in FIG. 3. Globules of adhesive or other fluid are thus periodically transferred to the web in the shape of a transverse line or dash. The adhesive metering will, of course, be synchronous to web speed proportional to bumping frequency.

In preferred operation, irrespective of the diameter of bumper roll 7, the position of the nozzle 5 will be relatively located at the bottom side of the web at substantially the same angle A, such that the relative dimensional positions change proportionately with bumper roll diameter. In most applications with adhesive applications on paper and similar webs, this angle of position A of the nozzle is preferably approximately 15°. This angle is substantially the same as the deflection angle the deflected web 1 makes with the horizontal axis of the idler roll 3.

As an example, if it be assumed that the bumper roll 7 is of six-inch circumference, the position of the nozzle 5 may be located approximately one-eighth to three-sixteenths inch off the center line of the bumper roll. For a larger circumference bumper roll 7, say 22 inches in circumference, the position of the bumper roll 7 may be approximately five-eighths to nine-sixteenths inch to the side of the vertical center axis of the bumper roll. The time of contact with the nozzle orifice 5′ can be varied, moreover, with variation of the angle A, including even to an equivalent angle on the other side of said vertical axis for reverse effects. It has been found, for the applications above mentioned, however, that there is an optimum position for momentary contact of the web and relatively stationary nozzle orifice, with sharp lift-off following bumper roll projection contact with the upper side of the web; namely, substantially the before mentioned angle of about 15° of nozzle displacement from the vertical axis of the bumper roll 7 and of web deflection from the horizontal axis of the idler roll 3.

In the modification of FIG. 5, the nozzle 5 is provided with a curved segment 5″ on the aft portion substantially concentric with or corresponding approximately to the curvature of the bumper roll 7. This construction enables the attainment of a slurred pattern of adhesive application, indicated in dotted lines, in the direction of the web travel, as for such purposes as remoistenable adhesive layers for subsequent finishing into envelopes or the like. The transverse bumper projection or blade 11 is shown in the form of a tapered blade for producing the desired wipe pattern. The metering is controlled, as described in said Letters Patent, for example, but is timed to produce adhesive globules at substantially the time of and between periodic deflections at the web.

In the embodiment of FIG. 4, on the other hand, the wiping surface of the nozzle 5 is concavely constructed at 5‴, again substantially paralleling the curvature of the bumper roll 7, but this time with the orifice 5′ substantially alined with the vertical axis of the bumper role 7. By rotating the bumper roll 7 oppositely to the direction of web travel, this construction can create a longer dwell time and consequently a longer slur wiping pattern than in the embodiment of FIG. 5, and more defined start and stop edges.

As before stated in connection with the relative speeds of the bumper roll rotation and of the moving web, it has been found that if the speed of the bumper roll mechanism (taking into account the number of bumper projections) is made substantially equal to or faster than the effective web speed, the definition of adhesive application across the web is sharp and well defined; whereas if the speed of the bumper roll mechanism is adjusted effectively to be less than web speed, a slurring action occurs, causing the adhesive or other application to be less well-defined. For instance, in an envelope application, the relative speeds experienced to date by the system of the present invention, vary up to a thousand feet a minute, wherein the bumper roll, of 23 9/16 inch circumference, itself is travelling at the same speed as the web and contains four bumper uniformly spaced projections, 90° apart, per roll. This enabled pasting four times per press repeat, enabling four envelopes per press repeat to be adhesive coated at 1000 feet a minute per one-up installation.

In practical equipment adapted for use with existing press equipment, a plurality of successive bumper rolls 7 may be used as in FIGS. 1 and 2. Three such bumper rolls 7 are there shown, each roll having a total circumference of 23 9/16 inch and positions for from one to four bumpers projections or blades 11, to bump-wipe the incoming web 1 from one to four times per press repeat of the 23 9/16 inches. This capability provides the envelope-making line to produce one to four envelopes per press cut-off, being adaptable for not only one-up operation, but also a two-up and other multiple operation, as well. This can be effected because of the changing length of rolls that are capable of bringing in as much as a 20 inch wide web which, when slipped into two 10 inch webs, can each be cross-pasted simultaneously and then subsequently plowed over on top of each other to create two simultaneously two-up envelope streams as an output of the press.

In order to registrate the cross-pasted positions from the first to the second and third bumper rolls 7, slotted flanged drive adjustments 7′ are provided so that, when the press is shut down, the bolts may be loosened to advance or retard the relative positions with respect to each other in order to achieve the desired registration point, with such slotted and mating flange units providing this adjustment for phase generation. A phase variator 23, as of the endless chain loop type manufactured by Candy Manufacturing Company of Chicago, Ill., permits advancing or retarding the relative registration printing of the adhesive application to desired positions, at will, during running, by advancing or retarding the output sprocket drive 23′ to the cross-pasted bumper system; other types of known adjustment devices may also be used, such as a helical differential drive unit with a worm and worm gear assembly, for achieving the same end result, though the chain loop system is less expensive for the loads and the speeds intended in many applications of the invention.

In many applications, adhesive will not properly slur or grab or adhere to a moving web because of lack of compatibility of wetting properties of the adhesive and the paper, film, foil or other web substrate. It has been found that to create more attractiveness for a fluid, such as hot-melt adhesive such as pvc or polyethelene films or the materials discussed in said Letters Patent, to a moving web, and to enable application in a very low film thickness, such as one-thousandths of an inch, the web should be pre-heated and the metering adjusted to provide globule production that adheres in the periods of bumper projection contact and/or immediately thereafter, adjacent to or just after its entering the idler roll 3, as schematically shown by the arrow H, FIG. 3. The heating system may be of conventional types, such as hot air, radiant heaters, or even a hot iron placed on the moving web.

It is desired to contrast the approach of the invention with other available adhesive-application techniques and thus illustrate the marked improvement and flexibility attainable with the invention. As before stated, the bumper roll 7 can rotate at the same surface speed as the web or rotate faster than web speed. For example, a multiple print repeat printing press having repeat capability of 17, 22, 23 3/4, 23 9/16, 26¼ inches, would require a bumper system containing bumper rolls of 26¼ inch circumference. Since the press line shaft always rotates the same number of times per print repeat, the bumper roll would be running at surface speeds greater than web speeds; i.e. on one day, the set up might be for a 26¼ inch press repeat, whereas, the next job might require a 17 inch press repeat. The bumper roll 7 will pass 26¼ inches of travel for 17 inches of web. Therefore, the bumper roll does not "know" at what speed it is running, so long as its speed is equal to or faster than web speed. This is totally different from the conventional printing of adhesives on webs where the web speed and printing cylinder speeds have to be matched to obtain application repeat. It can thus be seen that prior-art changing of cylinders for different repeats is not required for the bumper approach of the present invention.

While the invention has been described with reference to envelope adhesive applications, it is clear that it can also be applied to other uses, including on presses that are producing magazine tabloids and signatures coming off the end of the printing press and subsequently passed into a bindery operation and then saddle-stitched or perfect-bound in book form. Other modifications will also occur to those skilled in this art, and all such are considered to fall within the spirit and scope of the invention as defined in the appended claims.

What is claimed is:

1. Fluid application apparatus having, in combination, means for longitudinally feeding a sheet along a predetermined path past a predetermined location spaced from said sheet at one side thereof, projection means at the opposite side of said sheet movable along a curved path about an axis transverse to and spaced from the path of said sheet, and spaced from said location along the direction of sheet movement, into engagement with said sheet for deflecting it substantially to said location, extrusion nozzle means at said location providing fluid contacted by the deflected sheet and having a wiping surface generally associated with said path of the projection means, and means for periodically moving said projection means along its path to deflect said sheet and cause fluid contacted by the deflected sheet to be wiped onto the sheet as a coating as the sheet travels along said wiping surface.

2. Fluid application apparatus as claimed in Claim 1 and in which said projection means is supported upon rotatable bumper roll means and in which said means for moving said projection means comprises means for rotating said bumper roll means so that said projection means moves at a speed at least as great as the speed of movement of the sheet and in substantially the same direction as the movement of said sheet while said projection means engages said sheet.

3. Fluid application apparatus as claimed in claim 1 and in which the angle between a line extending from said axis to said location and a line extending from said axis substantially perpendicularly to said path is about 15°.

4. Fluid application apparatus as claimed in claim 3 and in which the angle between said path and said sheet deflected substantially to said location is about 15°.

5. Fluid application apparatus as claimed in claim 1 and in which said wiping surface is concave and has a curvature substantially corresponding to the curvature of the path of said projection means.

6. Fluid application apparatus having, in combination, means for longitudinally feeding a sheet along a predetermined path past a predetermined location spaced from said sheet at one side thereof, projection means at the opposite side of said sheet movable along a curved path into engagement with said sheet for deflecting it substantially to said location, fluid nozzle means at said location providing fluid contacted by the deflected sheet at a fluid outlet in a concave surface having a curvature substantially corresponding to the curvature of the path of said projection means, and means for periodically moving said projection means along its path to deflect said sheet and cause fluid contacted by the deflected sheet to be wiped along said surface and onto said sheet as a coating.

7. Fluid application apparatus as claimed in claim 6 and in which said projection means is supported upon rotatable bumper roll means having a rotational axis spaced from and transverse to said path of said sheet, said axis and said outlet lying in a plane substantially perpendicular to the path of said sheet.

8. Fluid application apparatus as claimed in claim 7, and in which said means for moving said projection means comprises means for rotating said bumper roll means in a direction such that said projection means moves in a direction substantially opposite to the movement of said sheet while engaged therewith.

* * * * *